US007098876B2

(12) United States Patent
Jeong et al.

(10) Patent No.: US 7,098,876 B2
(45) Date of Patent: Aug. 29, 2006

(54) IMAGE DISPLAY METHOD AND SYSTEM FOR PLASMA DISPLAY PANEL

(75) Inventors: Jae-Seok Jeong, Ahsan (KR); Tae-Kyong Kwon, Cheonan (KR); Nam-Sung Jung, Cheonan (KR); Cheol-Hong Kim, Kyungki-do (KR)

(73) Assignee: Samsung SDI Co., Ltd., Suwon (KR)

( * ) Notice: Subject to any disclaimer, the term of this patent is extended or adjusted under 35 U.S.C. 154(b) by 194 days.

(21) Appl. No.: 10/222,909

(22) Filed: Aug. 19, 2002

(65) Prior Publication Data

US 2003/0048242 A1 Mar. 13, 2003

(30) Foreign Application Priority Data

Sep. 6, 2001 (KR) ..... 2001-54760
Apr. 12, 2002 (KR) ..... 2002-19933

(51) Int. Cl.
*G09G 3/28* (2006.01)

(52) U.S. Cl. ..... 345/63; 345/60; 345/61; 345/62; 345/64; 345/65; 345/66

(58) Field of Classification Search ..... 345/60–68, 345/89, 147, 136, 150, 196, 419, 420, 427, 345/690–693, 429–431, 433, 437, 501, 204, 345/694, 208–210, 215, 589; 348/745, 746, 348/447, 797; 358/521, 523; 315/169.4
See application file for complete search history.

(56) References Cited

U.S. PATENT DOCUMENTS 5,375,002 A * 12/1994 Kim et al. ..... 358/521
5,757,343 A 5/1998 Nagakubo ..... 345/63
6,144,364 A 11/2000 Otobe et al. ..... 345/147
6,249,265 B1 * 6/2001 Tajima et al. ..... 345/63
6,310,588 B1 * 10/2001 Kawahara et al. ..... 345/63
6,414,658 B1 * 7/2002 Tokunaga ..... 345/63
6,456,302 B1 * 9/2002 Kawahara et al. ..... 345/693
6,456,340 B1 * 9/2002 Margulis ..... 348/745

(Continued)

FOREIGN PATENT DOCUMENTS

CN 1293803 5/2001

(Continued)

OTHER PUBLICATIONS

International Search Report for PCT/JP98/05508 mailed Mar. 15, 1999.

(Continued)

*Primary Examiner*—Vijay Shankar
*Assistant Examiner*—Prabodh Dharia
(74) *Attorney, Agent, or Firm*—H.C. Park & Associates, PLC

(57) ABSTRACT

An image of each field displayed on a plasma display panel corresponding to input image signals is divided into sub-fields of different weights, the sub-fields being divided into two continuous sub-field groups having a different weighting value, and in which the weighting values of the sub-fields combine to display grays. The method includes generating original grays; determining a diffusion filter value; generating final grays by applying the diffusion filter value to the original grays; generating gray data corresponding to the final grays, the gray data being distributed over the two sub-field groups; and displaying an image on the PDP according to the gray data. The disclosed method and system reduce flicker and contour noise and other display problems associated with the display of 50 Hz Phase Alternating by Line image signals.

33 Claims, 10 Drawing Sheets

U.S. PATENT DOCUMENTS

| | | | | |
|---|---|---|---|---|
| 6,476,824 | B1 * | 11/2002 | Suzuki et al. | 345/690 |
| 2001/0028347 | A1 * | 10/2001 | Kawahara et al. | 345/204 |
| 2001/0045923 | A1 * | 11/2001 | Otobe et al. | 345/63 |
| 2002/0135595 | A1 * | 9/2002 | Morita et al. | 345/589 |
| 2002/0158820 | A1 * | 10/2002 | Hoppenbrouwers | 345/60 |
| 2003/0218778 | A1 * | 11/2003 | Ohta | 358/3.04 |
| 2004/0160527 | A1 * | 8/2004 | Correa et al. | 348/447 |
| 2005/0078060 | A1 * | 4/2005 | Shigeta et al. | 345/63 |

FOREIGN PATENT DOCUMENTS

| | | | |
|---|---|---|---|
| EP | 0 653 740 | A2 | 5/1995 |
| EP | 0 755 043 | A1 | 1/1997 |
| EP | 0 982 707 | A1 | 3/2000 |
| JP | 6-259034 | | 9/1994 |
| JP | 8-286636 | | 11/1996 |
| KR | 2000-0070948 | | 11/2000 |
| WO | WO 99/30308 | | 6/1999 |

OTHER PUBLICATIONS

International Search Report dated Feb. 14, 2005.

* cited by examiner

10

| | | | | | | | |
|---|---|---|---|---|---|---|---|
| 0 | +K | 0 | −K | 0 | +K | 0 | −K |
| +K | 0 | −K | 0 | +K | 0 | −K | 0 |
| 0 | −K | 0 | +K | 0 | −K | 0 | +K |
| −K | 0 | +K | 0 | −K | 0 | +K | 0 |

20

| | | | | | | | |
|---|---|---|---|---|---|---|---|
| 0 | −K | 0 | +K | 0 | −K | 0 | +K |
| −K | 0 | +K | 0 | −K | 0 | +K | 0 |
| 0 | +K | 0 | −K | 0 | +K | 0 | −K |
| +K | 0 | −K | 0 | +K | 0 | −K | 0 |

FIG.3A

| Sub-field | SF1 | SF2 | SF3 | SF4 | SF5 | SF6 | SF7 | Suspension interval | SF1 | SF2 | SF3 | SF4 | SF5 | SF6 | SF7 | Suspension interval |
|---|---|---|---|---|---|---|---|---|---|---|---|---|---|---|---|---|
| Weight | 1 | 4 | 8 | 16 | 24 | 32 | 40 | | 2 | 4 | 8 | 16 | 24 | 32 | 40 | |
| 109 grays (N) | ON | ON | ON | ON | ON | OFF | OFF | 52 | OFF | OFF | ON | ON | OFF | ON | OFF | 56 |
| 110 grays (N+1) | OFF | OFF | ON | ON | OFF | ON | OFF | 53 | ON | ON | ON | ON | ON | OFF | OFF | 56 |
| 109 grays (N) | ON | ON | ON | ON | ON | OFF | OFF | 53 | OFF | OFF | ON | ON | OFF | ON | OFF | 56 |
| 108 grays (N−1) | OFF | ON | ON | ON | ON | OFF | OFF | 56 | OFF | OFF | ON | ON | OFF | ON | OFF | 54 |
| ON number (4 pixel unit) | 2 | 3 | 4 | 4 | 3 | 1 | 0 | | 1 | 1 | 4 | 4 | 1 | 3 | | |
| | G1 | | | | | | | | G2 | | | | | | | |

FIG.3B

| Sub-field | SF1 | SF2 | SF3 | SF4 | SF5 | SF6 | SF7 | Suspension interval | SF1 | SF2 | SF3 | SF4 | SF5 | SF6 | SF7 | Suspension interval |
|---|---|---|---|---|---|---|---|---|---|---|---|---|---|---|---|---|
| Weight | 1 | 4 | 8 | 16 | 24 | 32 | 40 | | 2 | 4 | 8 | 16 | 24 | 32 | 40 | |
| 109 grays (N) | ON | ON | ON | ON | ON | OFF | OFF | 52 | OFF | OFF | ON | ON | OFF | ON | OFF | 56 |
| 108 grays (N−1) | OFF | ON | ON | ON | ON | OFF | OFF | 53 | OFF | OFF | ON | ON | OFF | ON | OFF | 56 |
| 109 grays (N) | ON | ON | ON | ON | ON | OFF | OFF | 53 | OFF | OFF | ON | ON | OFF | ON | OFF | 56 |
| 110 grays (N+1) | OFF | OFF | ON | ON | OFF | ON | OFF | 56 | ON | ON | ON | ON | ON | OFF | OFF | 54 |
| ON number (4 pixel unit) | 2 | 3 | 4 | 4 | 3 | 1 | 0 | | 1 | 1 | 4 | 4 | 1 | 3 | | |
| | G1 | | | | | | | | G2 | | | | | | | |

FIG.12

PRIOR ART

| Sub-field | SF1 | SF2 | SF3 | SF4 | SF5 | SF6 | SF7 | Suspension interval | SF1 | SF2 | SF3 | SF4 | SF5 | SF6 | SF7 | Suspension interval |
|---|---|---|---|---|---|---|---|---|---|---|---|---|---|---|---|---|
| Weight | 1 | 4 | 8 | 16 | 24 | 32 | 40 | | 2 | 4 | 8 | 16 | 24 | 32 | 40 | |
| | G1 | | | | | | | | G2 | | | | | | | |

FIG.13

PRIOR ART

| Sub-field | SF1 | SF2 | SF3 | SF4 | SF5 | SF6 | SF7 | Suspension interval | SF1 | SF2 | SF3 | SF4 | SF5 | SF6 | SF7 | Suspension interval |
|---|---|---|---|---|---|---|---|---|---|---|---|---|---|---|---|---|
| Weight | 1 | 4 | 8 | 16 | 24 | 32 | 40 | | 2 | 4 | 8 | 16 | 24 | 32 | 40 | |
| 109 grays | ON | ON | ON | ON | ON | OFF | OFF | | OFF | OFF | ON | ON | OFF | ON | OFF | |
| 109 grays | ON | ON | ON | ON | ON | OFF | OFF | | OFF | OFF | ON | ON | OFF | ON | OFF | |
| 109 grays | ON | ON | ON | ON | ON | OFF | OFF | | OFF | OFF | ON | ON | OFF | ON | OFF | |
| 109 grays | ON | ON | ON | ON | ON | OFF | OFF | | OFF | OFF | ON | ON | OFF | ON | OFF | |
| ON number | 4 | 4 | 4 | 4 | 4 | 0 | 0 | | 0 | 0 | 4 | 4 | 0 | 4 | 0 | |
| | G1 | | | | | | | | G2 | | | | | | | |

IMAGE DISPLAY METHOD AND SYSTEM FOR PLASMA DISPLAY PANEL

BACKGROUND OF THE INVENTION

1. Field of the Invention

The present invention relates to an image display method and system for a plasma display panel. More particularly, the present invention relates to an image display method and system for a plasma display panel that reduces flicker, contour noise, interference patterns, and other such problems when an image is realized by the input of 50 Hz Phase Alternating by Line image signals.

2. Description of the Related Art

A plasma display panel (PDP) is a display device in which a plurality of discharge cells are arranged in a matrix, and the discharge cells are selectively illuminated to restore image data, which are input as electrical signals.

In such a PDP, the display of gray must be possible in order to exhibit the capabilities of a color display device. A gray realization method is used to achieve this, in which a single field is divided into a plurality of sub-fields and the sub-fields are controlled by a process of time sharing.

A major concern for the designer of such display devices is that of flicker. Flicker is closely related to how the human eye perceives images. Generally, flicker becomes more perceptible as screen size is made larger and as display frequency is lowered. In the case where images are realized in a PDP using Phase Alternating by Line (PAL) image signals, both these factors are present such that a significant amount of flicker is generated.

Accordingly, if the PDP is driven at a vertical frequency of 50 Hz using a minimum increase arrangement or using a minimum decrease arrangement, which are sub-field arrangements typically used in PDPs, a great amount of flicker is generated.

Among the factors that make flicker more problematic, since it is not possible to change the screen size, flicker must be reduced by varying frequency. Korean Laid-open Patent No. 2000-16955 discloses a method of reducing flicker by adjusting frequency. In that disclosure, to reduce flicker in a PDP having a large screen and being operated by the input of 50 Hz image signals, sub-fields within a single field are divided into two groups (G1 and G2), and a weight arrangement of the sub-fields in each group is identical or all sub-field arrangements except an LSB (Least Significant Bit) sub-field have the same structure. Further, a feature of that disclosure is that a brightness weighting value in the two sub-field groups is identically distributed. The reduction of flicker with the use of this method is greatly improved over the conventional sub-field arrangement of a minimum increase arrangement or a minimum decrease arrangement.

FIG. 12 is a schematic view of a conventional sub-field arrangement, and FIG. 13 is a schematic view showing an example of On/Off control of each sub-field in grays generating flicker in the case where a conventional sub-field arrangement is used to realize grays. As shown in the drawings, in order to realize the display of 109 grays, 53 grays are displayed in group G1 and 56 grays are displayed in group G2.

Sub-fields SF1 to SF5 are On in group G1; and sub-fields SF3, SF4, and SF6 are On in group G2. Accordingly, in the case of the upper sub-field SF6, the number of lines On in group G1 is 0 since all lines are Off, and the number of lines On in group G2 is 4 since all lines are On such that a weight difference (i.e., the difference in the number of lines On) is 4. Because of this large difference, an illuminating central axis position of each group (G1 and G2) is different, resulting in the generation of flicker. Although only four lines were described in this example, in the case where more lines have the same gray, for example, in the case where all 480 lines in a 480×640 size screen have the same gray, the difference in the number of lines On becomes 480 such that the user sees a considerable amount of flicker.

There are many instances when grays of adjacent pixels in an image displayed on a screen are identical. Accordingly, if an image having identical grays over a number of lines is displayed, flicker that is visible to the human eye is generated as a result of the sub-field weight difference between the sub-field groups (G1 and G2) as described above.

The display of grays in the prior art by distributing brightness weights in each group (G1 and G2) does not reduce flicker in all grays of image signals. That is, when displaying grays, if an uppermost weight of the sub-fields displaying grays assigned to group G1 and an uppermost weight of the sub-fields displaying grays assigned to group G2 are different, a discrepancy in the illuminating central axis positions occurs in the two groups. Flicker is generated as a result.

SUMMARY OF THE INVENTION

It is one object of the present invention to provide an image display method and system for a PDP, in which sub-fields are diffused using a diffusion filter, which utilizes human visual perception characteristics, such that flicker and contour noise are reduced.

It is another object of the present invention to provide an image display method and system for a PDP, in which a prime (number) diffusion filter is used to prevent the generation of interference patterns by the simultaneous utilization of a diffusion filter and an error diffusion process.

In a first embodiment related to the method, the present invention provides an image display method for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the method including generating original grays based on the input image signals; determining a diffusion filter value based on the input image signals; generating final grays by applying the diffusion filter value to the generated original grays; generating gray data corresponding to the generated final grays, the gray data being distributed over the two sub-field groups; and displaying an image on the plasma display panel according to the generated gray data.

According to a feature of the first embodiment present invention, the diffusion filter value is established differently for an even field and for an odd field of the input image signals.

According to another feature of the first embodiment of the present invention, the diffusion filter value for the even field and the diffusion filter value for the odd field are established to compensate for each other with respect to specific pixels.

In a first embodiment related to the system, the present invention provides an image display system for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system including an image signal processor digitizing the input image signals to generate digital image data; a sub-field coding unit applying a diffusion filter value, which is determined based on the input image signals, to original grays generated based on the digital image data generated by the image signal processor to thereby generate final grays, and generating gray data corresponding to the final grays, the gray data being distributed over the two sub-field groups; and an address designating unit performing control such that images corresponding to the gray data output by the sub-field coding unit are displayed on the PDP.

In a second embodiment related to the method, the present invention provides an image display method for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the method including converting original image data corresponding to the image signals by using a prime diffusion filter(s) having prime diffusion filter coefficients; generating final image data by performing an error diffusion process by regarding a portion of gray data of the input image signals as errors and diffusing the errors in the converted original image data to correspond to each adjacent pixel; and performing control such that images corresponding to the generated final image data are displayed on the PDP.

According to a feature of the second embodiment of the present invention, the prime diffusion filter coefficients are prime number coefficients or coefficients obtained by combining a prime number and a real number.

According to another feature of the second embodiment of the present invention, the prime diffusion filter coefficients possessed by the prime diffusion filter(s) are realized by pattern signals that have reverse characteristics in a horizontal direction and in a vertical direction with respect to the pixels.

According to yet another feature of the second embodiment of the present invention, the prime diffusion filter coefficients possessed by the prime diffusion filter(s) are realized by pattern signals that have reverse characteristics in a time direction with respect to the pixels, and wherein the time direction is specified by a plurality of frames, and prime diffusion filter coefficients possessed by each prime diffusion filter applied to each of the frames have reverse characteristics with respect to adjacent frames.

In a third embodiment related to the method, the present invention provides an image display method for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields being combined to display grays, the method including converting original image data corresponding to the image signals by using a first prime diffusion filter having a first prime diffusion filter coefficient; performing an error diffusion process on the converted original image data by regarding a portion of gray data of the image data as errors and diffusing the errors to the adjacent pixels by a predetermined amount corresponding to each adjacent pixel; converting the image data having undergone the error diffusion process to generate final image data, the converting of the image data being performed by using a second prime diffusion filter having a second prime diffusion filter coefficient; and performing control such that images corresponding to the generated final image data are displayed on the PDP.

According to a feature of the third preferred embodiment of the present invention, the first prime diffusion filter applies the first prime diffusion filter coefficient to the input image data corresponding to low gray regions.

According to another feature of the third preferred embodiment of the present invention, the first prime diffusion filter coefficient is a prime number coefficient or a coefficient obtained by combining a prime number and a real number.

According to yet another feature of the third preferred embodiment of the present invention, the second prime diffusion filter applies the second prime diffusion filter coefficient to the input image data corresponding to a region extending from intermediate gray regions to high gray regions.

According to still yet another feature of the third preferred embodiment of the present invention, the second prime diffusion filter coefficient is a prime number coefficient or a real number coefficient.

In a second embodiment related to the system, the present invention provides an image display system for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system including an image signal processor generating digital image data by digitizing the input image signals; a prime diffusion filter processor converting the digital image data by using a specified prime diffusion filter coefficient on the digital image data output by the image signal processor, then outputting a result of this process; an error diffusion unit generating final image data by performing an error diffusion process on the converted original image data by regarding a portion of gray data of the image data as errors and diffusing the errors to the adjacent pixels by a predetermined amount corresponding to each adjacent pixel; a memory controller generating sub-field data corresponding to the final image data generated by the error diffusion unit, and applying the sub-field data to the PDP; and a sustain/scan pulse driver controller generating a sub-field arrangement structure corresponding to the final image data generated by the error diffusion unit, generating control signals based on the generated sub-field arrangement structure, and applying the control signals to the PDP.

In a third embodiment related to the system, the present invention provides an image display system for a PDP, in which an image of each field displayed on the PDP corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system including an image signal processor generating digital image data by digitizing the input image signals; a first prime diffusion filter processor converting the digital image data by using a specified first prime diffusion filter coefficient on the digital image data output by the image signal processor, then outputting a result of this process; an error diffusion unit generating final image data by performing an error diffusion process on the image data output from the prime diffusion filter processor by regarding a portion of gray data of the image data as errors and diffusing the errors to the adjacent pixels by a predetermined amount corresponding to each adjacent pixel; a second prime diffusion filter processor converting the image data having undergone the error diffusion process by using a specified second prime diffusion filter coefficient on the image data having undergone the error diffusion process by the error diffusion unit, then outputting resulting final image data; a memory controller generating sub-field data corresponding to the final image data generated by the second prime diffusion filter processor, and applying the sub-field data to the PDP; and a sustain/scan pulse driver controller generating a sub-field arrangement structure corresponding to the final image data generated by the second prime diffusion filter processor, generating control signals based on the generated sub-field arrangement structure, and applying the control signals to the PDP.

BRIEF DESCRIPTION OF THE DRAWINGS

The accompanying drawings, which are incorporated in and constitute a part of the specification, illustrate an embodiment of the invention, and, together with the description, serve to explain the principles of the invention, in which:

FIG. 2A shows an even field diffusion filter and FIG. 2B shows an odd field diffusion filter;

FIGS. 3A and 3B show On/Off states of each sub-field with respect to gray data resulting from the application of the diffusion filters of FIGS. 2A and 2B, where FIG. 3A shows On/Off states of each sub-field with the application of the even field diffusion filter, and FIG. 3B shows On/Off states of each sub-field with the application of the odd field diffusion filter;

FIG. 12 is a schematic view of a conventional sub-field arrangement; and

FIG. 13 is a schematic view showing an example of On/Off control of each sub-field in grays generating flicker in the case where a conventional sub-field arrangement is used to realize grays.

DETAILED DESCRIPTION OF THE PREFERRED EMBODIMENTS

Preferred embodiments of the present invention will now be described in detail with reference to the accompanying drawings.

Figures 1, 2A, 2B:
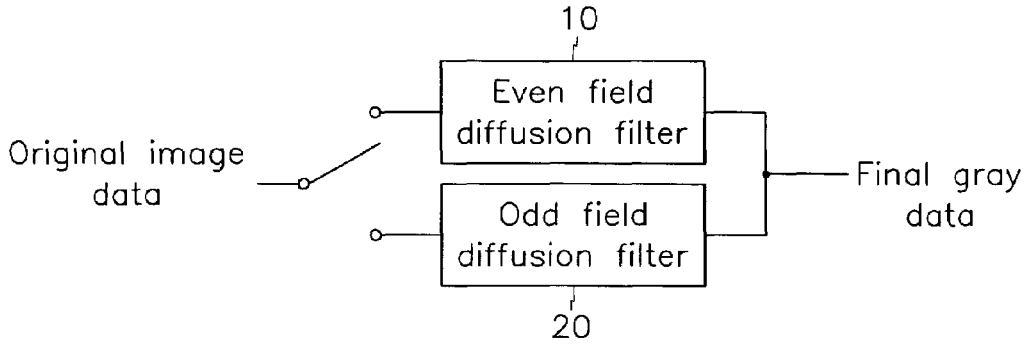
FIG. 1 is a schematic view of an image display method for a PDP according to a first preferred embodiment of the present invention.
FIGS. 2A and 2B show examples of diffusion filters of FIG. 1, where

FIG. 1 is a schematic view of an image display method for a PDP according to a first preferred embodiment of the present invention.

With reference to FIG. 1, as a method that visually diffuses generated gray flicker, an image display method for a PDP according to a first preferred embodiment of the present invention applies diffusion filters in original gray data, which are determined by external image signals, to generate final gray data. The diffusion filters include an even field diffusion filter 10 applied to even field gray data, and an odd field diffusion filter 20 applied to odd field gray data.

It is preferable that gray data conversion by the even field diffusion filter 10 and gray data conversion by the odd field diffusion filter 20 are performed to enable signal processing in opposite directions with respect to specific pixels. For example, if the even field diffusion filter 10 performs conversion of gray data by adding a certain filter value n to the gray data of an even field with respect to a specific pixel, the odd field diffusion filter 20 performs conversion of the gray data by subtracting the filter value n from gray data of an odd field with respect to the specific pixel in order to compensate for the signal processing by the even field diffusion filter 10.

FIGS. 2A and 2B show examples of the diffusion filters of FIG. 1, where FIG. 2A shows the even field diffusion filter 10, and FIG. 2B shows the odd field diffusion filter 20.

As shown in the drawings, the even field diffusion filter 10 and the odd field diffusion filter 20 add one of 0, +k, or −k to original gray data to convert the original gray data. Further, so that the gray data converted by the even field diffusion filter 10 and the odd field diffusion filter 20 with respect to specific pixels compensate each other, a value of the even field diffusion filter 10 and a value of the odd field diffusion filter 20 add to 0.

As described above, the even field diffusion filter 10 and the odd field diffusion filter 20 take on one of the values of 0, +k, or −k. In the first preferred embodiment of the present invention, it is to be assumed for convenience of explanation that +k equals 1 and −k equals −1. Therefore, the even field diffusion filter 10 and the odd field diffusion filter 20 take on one of the values of 0, +1, or −1.

FIGS. 3A and 3B show On/Off states of each sub-field with respect to gray data resulting from the application of the even field and odd field diffusion filters 10 and 20 of FIGS. 2A and 2B to the gray data that generate flicker as shown in FIG. 13. FIG. 3A shows On/Off states of each sub-field with the application of the even field diffusion filter 10, and FIG. 3B shows On/Off states of each sub-field with the application of the odd field diffusion filter 20.

As shown in FIGS. 3A and 3B, the results of converting the original gray data using the even field diffusion filter 10 and the odd field diffusion filter 10 are such that a difference in the number of On between group G1 and G2 with respect to sub-field SF6 is 2, and this difference is not exceeded for all even and odd fields. This is a significant reduction over the prior art, and indicates a reduction in the weight difference particularly in the upper sub-fields. Accordingly, flicker is reduced with the use of the even field and odd field diffusion filters 10 and 20 according to the first preferred embodiment of the present invention.

Figure 4:
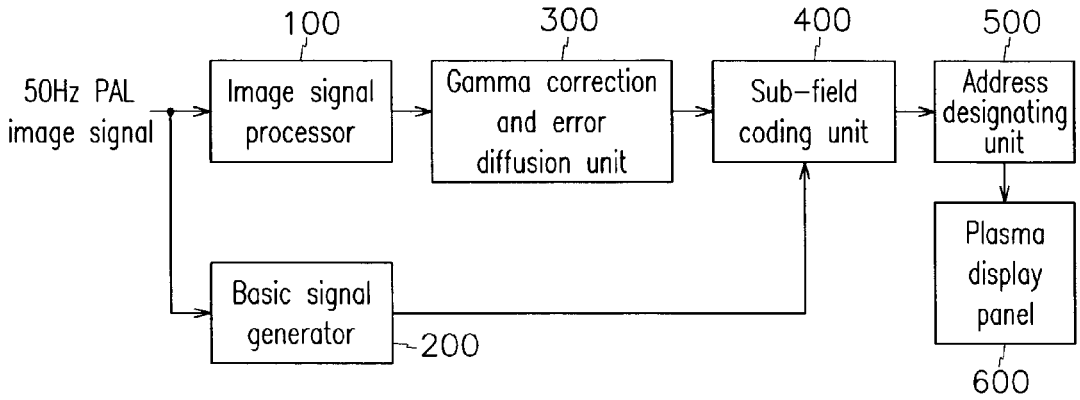
FIG. 4 is a block diagram of an image display system for a PDP according to a first preferred embodiment of the present invention.

FIG. 4 is a block diagram of an image display system for a PDP according to a first preferred embodiment of the present invention.

The image display system includes an image signal processor 100, a basic signal generator 200, a gamma correction and error diffusion unit 300, a sub-field coding unit 400, and an address designating unit 500. Reference numeral 600 indicates a plasma display panel. The image signal processor 100 digitizes 50 Hz PAL image signals, which are received externally, to generate RGB data.

The basic signal generator 200 generates basic signals for processing image signals. The basic signals include a vertical synchronization signal (Vsync) that becomes a reference of a field signal, a horizontal synchronization signal (Hsync) that becomes a reference of each line, and a clock signal (Clock) that becomes a reference for all signal processing.

The gamma correction and error diffusion unit 300 receives the RGB data that are output from the image signal processor 100 to perform correction of gamma values to correspond to the characteristics of the PDP 600, and, simultaneously, to perform diffusion processing of display errors with respect to peripheral pixels. The gamma correction and error diffusion unit 300 then outputs a result of these processes.

The sub-field coding unit 400 receives the RGB data output from the gamma correction and error diffusion unit 300 and the basic signals generated by the basic signal generator 200, and generates gray data corresponding to each RGB pixel value. Grays corresponding to RGB pixel values are converted by an even field diffusion filter 10 and an odd field diffusion filter 20 in the sub-field coding unit 400 to determine final grays, and diffused gray data are generated by making reference to a look-up table 420 (see FIG. 5) provided in the sub-field coding unit 400.

With respect to these gray data, sub-fields in one field are divided into two groups G1 and G2, and a weight arrangement of the sub-fields for each group is identical or all sub-field arrangements except for an LSB (Least Significant Bit) sub-field have the same structure. Alternatively, a brightness weighting value in the two sub-field groups are identically distributed.

The address designating unit 500 includes a frame memory (not shown) that stores the gray data output from the sub-field coding unit 400. The address designating unit 500 controls the PDP 600 using the gray data stored in the frame memory.

Figure 5:
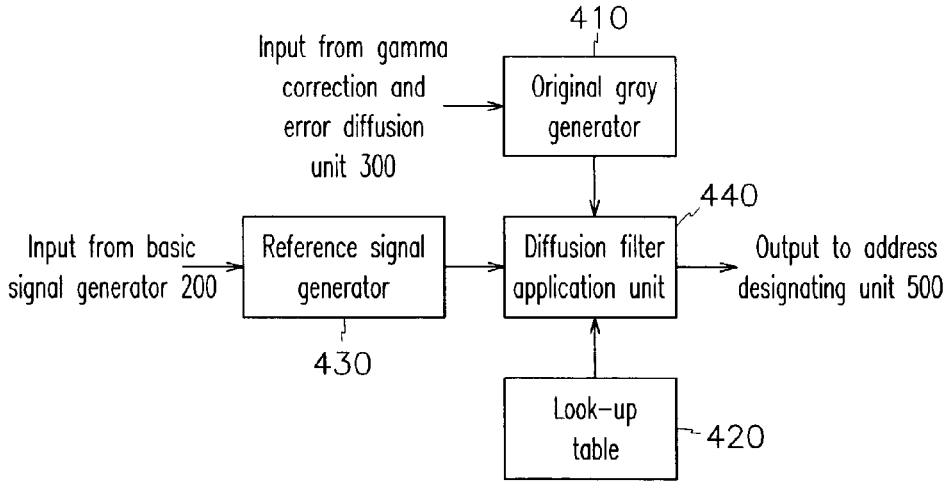
FIG. 5 is a detailed block diagram of a sub-field coding unit of FIG. 4.

FIG. 5 is a detailed block diagram of the sub-field coding unit 400 of FIG. 4.

As shown in the drawing, the sub-field coding unit 400 includes an original gray generator 410, the look-up table 420, a reference signal generator 430, and a diffusion filter application unit 440. The original gray generator 410 receives the RGB pixel values from the gamma correction and error diffusion unit 300 and generates corresponding original grays.

The reference signal generator 430 receives the basic signals (Vsync, Hsync, Clock) generated by the basic signal generator 200 and generates a reference signal for the application of a diffusion filter. The even field and the odd field are determined by the reference signal. The reference signal generator 430 also performs the operation of selecting a specific value of the diffusion filter, that is, one of 0, +k, or −k (i.e., 0, +1 or −1, in the examples provided herein).

The diffusion filter application unit 440 applies a diffusion filter value, which is determined according to the state of the reference signal generated by the reference signal generator 430, to the original grays generated by the original gray generator 410 to thereby generate final grays. The diffusion filter application unit 440 then generates gray data corresponding to these final grays by referencing the look-up table 420, after which the diffusion filter application unit 440 outputs the gray data to the address designating unit 500.

For example, if the original gray generator 410 generates 109 original grays, one of the filter values among the diffusion filter values of FIGS. 2A and 2B is selected according to the state of the reference signal generated by the reference signal generator 430 and this is added to the original grays. If the even field diffusion filter 10 of FIG. 2A is selected, then if the diffusion field value of the even field diffusion filter 10 of +k appearing in the second line, first column is selected, +k is added to the 109 original grays such that 109+k final grays are determined. If k is 1, a total of 110 final grays result, after which gray data corresponding to the 110 final grays are generated by referencing the look-up table 420.

Accordingly, the address designating unit 500 receives the gray data according to the final grays diffused by the diffusion filter, in which the gray data is different from the gray data of original grays, and performs control of the operation of the PDP 600. As a result, an image is realized in which flicker is reduced.

As described above, one of the diffused filter values among 0, +k, and −k is selected to perform conversion of original grays in the first preferred embodiment of the present invention. However, it is possible to omit 0 from the possible diffusion filter values so that selection among only +k and −k for use as the diffusion filter value is performed. Further, the order of the 0, +k, and −k diffusion filter values may also be different from the order as shown in FIGS. 2A and 2B.

In addition, although in the above description diffusion filters are applied to all pixels in the PDP, the present invention is not limited to this operation, and it is possible to apply diffusion filters to only those pixels in regions where flicker or contour noise is detected using conventional methods. However, such an operation may be easily understood by those skilled in the art with reference to the first preferred embodiment of the present invention and without providing a detailed description of this process.

Finally, although the k value, which is a coefficient of each diffusion filter, was assumed to be 1 in the description of the first preferred embodiment of the present invention, the k value may be varied for each predetermined input gray level.

Figure 6:
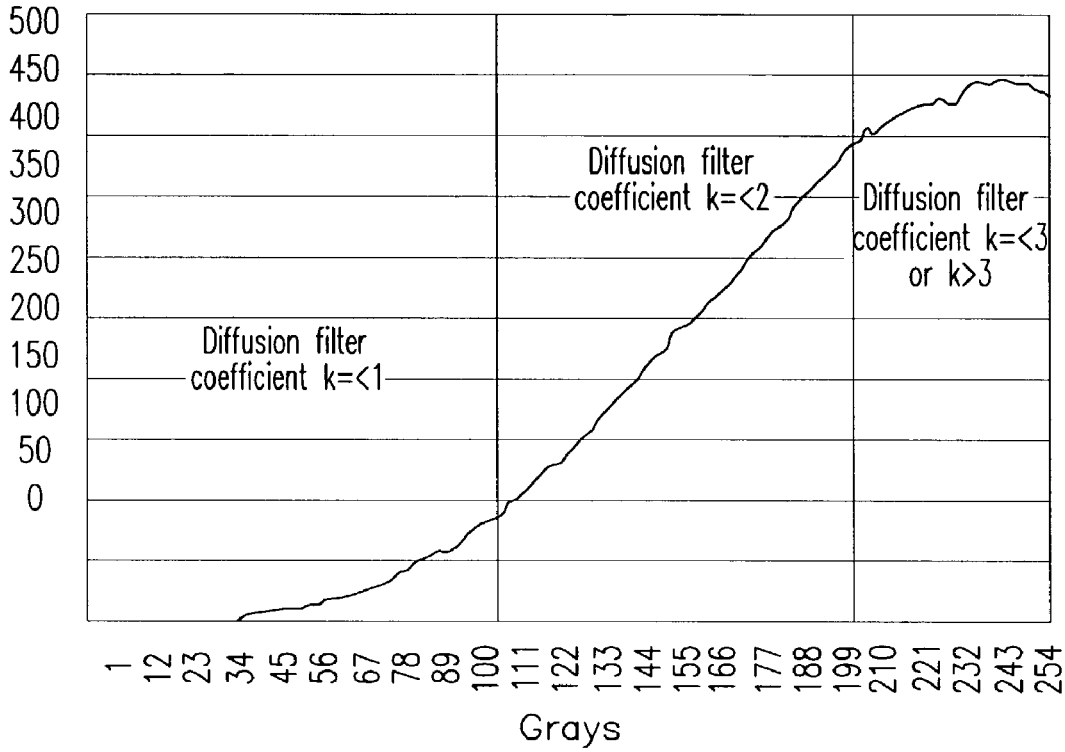
FIG. 6 is a graph showing how a diffusion filter coefficient value varies according to changes in gray in an image display system for a PDP according to a first preferred embodiment of the present invention.

As shown in the graph of FIG. 6, a gamma value is different depending on the gray level. That is, a gamma curve of the graph shows that the gamma value decreases going from a high gray region to a low gray region, indicating that visual perception becomes more sensitive as the low gray region is approached. As a result, application of a different diffusion filter value according to the gray level is such that image distortion according to gray level is either prevented or reduced.

In the case where there are a total of 256 gray levels, the diffusion filter coefficient k is designated such that $k \leqq 1$ for gray levels of less than 100, $k \leqq 2$ for gray levels greater than or equal 100 and less than 200, and $k \leqq 3$ or $k > 3$ for gray levels greater than or equal to 200. By using different diffusion filter values depending on the gray level, that is, by applying a diffusion filter value having a coefficient smaller than that of a high-gray region where visual perception is less sensitive to a lower gray region and an intermediate gray region where the visual perception is more sensitive, image distortion according to the gray levels is reduced.

In the case where multiple grays are displayed using a PDP, it is possible to experience degradation in picture quality as a result of an insufficient ability to display grays by the display device. An error diffusion method is used in which the number of grays, which is limited by such physical restraints, is increased by a method of utilizing spatial average grays between adjacent pixels. Such a process is performed by the gamma correction and error diffusion unit 300 (see FIG. 4) of the first preferred embodiment of the present invention.

However, if a PDP is driven simultaneously using both the diffusion filter, which is used to reduce contour noise as described above, and the error diffusion method, the conventional diffusion filter uses an integer diffusion filter coefficient to perform signal conversion with respect to the horizontal and vertical directions of the display pixels. As a result, in the case where the converted pixel data undergo an error diffusion process through the diffusion filter, interference patterns are generated at specific grays. The interference patterns are particularly problematic at low gray regions. That is, if a diffusion filter process is performed on the low gray regions, a resulting value of pixel data conversion of the low gray regions has an increased influence on the low gray regions since the diffusion filter coefficient is an integer. When the error diffusion process is performed with this increased influence present, interference patterns are generated at specific grays.

To solve this problem, a prime diffusion filter is used in the second and third preferred embodiments of the present invention, which will be described with reference to the drawings.

Figure 7A:
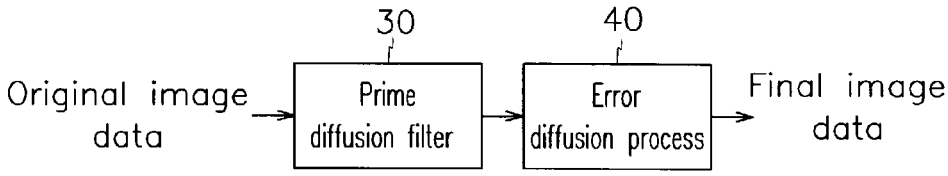
FIGS. 7A and 7B are schematic views showing two examples of image data conversion for the display of images in a PDP using a prime diffusion filter according to a preferred embodiment of the present invention.
Figure 7B:
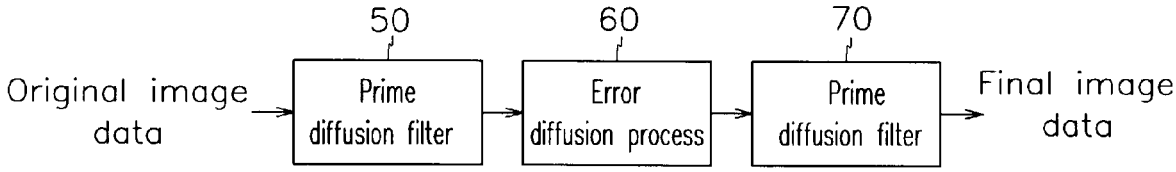

FIGS. 7A and 7B are schematic views showing two examples of image data conversion for the display of images in a PDP using a prime diffusion filter according to a preferred embodiment of the present invention.

With reference first to FIG. 7A, image data conversion for a PDP according to a preferred embodiment of the present invention is performed by generating final image data with the application of a prime diffusion filter 30 and an error diffusion process 40 to original image data corresponding to 50 Hz PAL image signals.

The prime diffusion filter 30 performs a prime diffusion filter process on original image data using a prime (number) diffusion filter coefficient or a coefficient in which a prime diffusion filter coefficient and a real (number) diffusion filter coefficient are combined, after which the prime diffusion filter 30 outputs resulting gray data. In the error diffusion process 40, an error that is diffused and received from a previous pixel is applied to image data that are output from the prime diffusion filter 30 (after having undergone the prime diffusion filter process therein) to thereby generate final image data.

It is possible for the prime diffusion filter 30 to use only a real diffusion filter coefficient (rather than only a prime diffusion filter coefficient). However, in the case where image data are converted by a real diffusion filter coefficient in the prime diffusion filter 30 and then undergo the error diffusion process 40, abnormal patterns may be generated at specific grays. That is, even though the effect of reducing contour noise is realized, abnormal patterns are generated as in the prior art. Therefore, rather than using only a real diffusion filter coefficient, it is preferable that either only a prime diffusion filter coefficient or a coefficient that combines a prime diffusion filter coefficient with a real diffusion filter coefficient is used to perform the diffusion filter process.

Referring to FIG. 7B, data corresponding to low gray regions in the original image data undergo a diffusion filter process in a prime diffusion filter 50, and data corresponding to regions of intermediate to high grays undergo a diffusion filter process in a prime diffusion filter 70. In an error diffusion process 60, an error that is diffused and received from a previous pixel is applied to image data that are output from the prime diffusion filter 50 (after having undergone a prime diffusion filter process therein) to thereby generate final image data.

The prime diffusion filter 50 performs a prime diffusion filter process on data of low gray regions using a prime diffusion filter coefficient or a coefficient in which a prime diffusion filter coefficient and a real diffusion filter coefficient are combined. The prime diffusion filter 70 of the second example, on the other hand, performs a prime diffusion filter process on data of regions from intermediate to high grays using a prime diffusion filter coefficient or a real diffusion filter coefficient. Although the prime diffusion filter 70 may also use a coefficient in which a prime diffusion filter coefficient and a real diffusion filter coefficient are combined, since the effect of the diffusion filter coefficient is small at regions from intermediate grays to high grays, contour noise may be reduced without the generation of abnormal patterns using only the real diffusion filter coefficient.

Further, although two examples of performing image data conversion by using a prime diffusion filter(s) and performing an error diffusion process were described above, the present invention is not limited to these two examples, and image data conversion may be performed in a variety of different ways. For example, in FIG. 7A, it is possible for the error diffusion process 40 to be performed before the process performed by the prime diffusion filter 30. That is, it is possible for the prime diffusion filter 30 to perform the prime diffusion filter process on data that have undergone the error diffusion process 40. Further, in FIG. 7B, the prime diffusion filter 50 may perform the prime diffusion filter process separately with respect to the intermediate gray regions and high gray regions.

Figure 8:
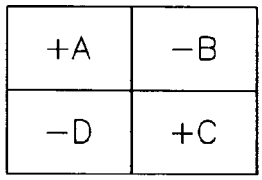
FIG. 8 is a drawing showing an example of a prime diffusion filter of FIG. 7.

FIG. 8 is a drawing showing an example of the prime diffusion filters of FIGS. 7A and 7B.

As shown in FIG. 8, the prime diffusion filters add to the original image data prime diffusion filter coefficients having reverse characteristics such as +A and −B, and −D and +C, in the horizontal direction for each row, and prime diffusion filter coefficients having reverse characteristics such as +A and −D, and −B and +C, in the vertical direction for each column, to thereby convert the original image data. +A, −B, +C, and −D of each coefficient may take on a prime number or real number value as shown in Table 1 below.

Figure 9:
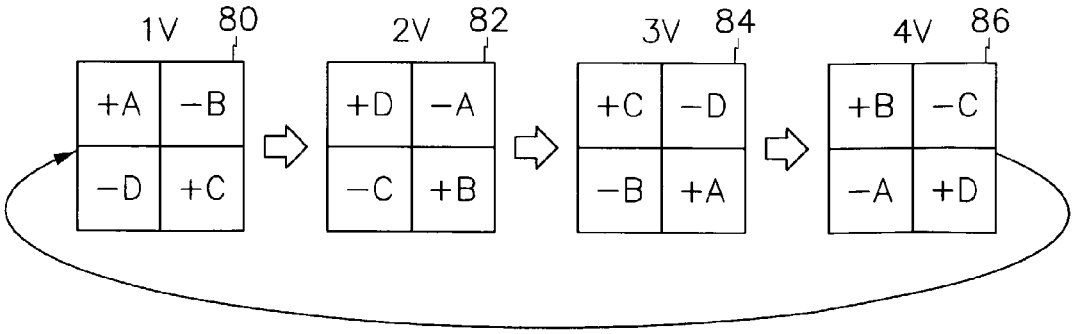
FIG. 9 is a drawing showing an example of each frame of a prime diffusion filter of FIG. 7.

With respect to FIG. 9, in the preferred embodiment of the present invention, prime diffusion filters 80, 82, 84, and 86 are applied with respect to a time direction, that is, a frame direction. With the application of the prime diffusion filters 80, 82, 84, and 86, the coefficients do not have reverse characteristics with respect to the frame direction.

In more detail, in a specific frame, for example a first vertical synchronization frame (1V), the prime diffusion filter 80 that uses diffusion filter coefficients of +A and −B, and −D and +C in the horizontal direction is applied for each row, and in a subsequent frame, that is, a second vertical synchronization frame (2V), the prime diffusion filter 82 that uses diffusion filter coefficients of +D and −A, and −C and +B in the horizontal direction for each row is applied. In yet another subsequent frame, that is, a third vertical synchronization frame (3V), the prime diffusion filter 84 that uses diffusion filter coefficients of +C and −D, and −B and +A in the horizontal direction for each row is applied, and in still yet another subsequent frame, that is, a fourth vertical synchronization frame (4V), the prime diffusion filter 86 that uses diffusion filter coefficients of +B and −C, and −A and +D in the horizontal direction for each row is applied.

TABLE 1

Examples of prime diffusion filter values

| Prime diffusion filter coefficients | Number type of value | Examples |
|---|---|---|
| +A | Prime or real number | 0.5 |
| −B | Prime or real number | −0.75 |
| +C | Prime or real number | 1.25 |
| −D | Prime or real number | −1 |

With the repeated alternating application of the four prime diffusion filters 80, 82, 84, and 86, a non-continuous signal level is displayed with respect also to pixels adjacent in the frame direction, that is, the time direction, and the original image level is realized at an average value. As a result, contour noise generated at smooth image continuous points is dispersed also in the time direction.

In the above, although the coefficients were described as not having reverse characteristics with respect to the frame direction, the present invention is not limited in this respect and it is possible for the coefficients to possess such reverse coefficients in the frame direction so that the average level becomes a signal level of the original image data. For example, if the coefficients of the prime diffusion filter 82 are applied after changing from +D to −D, from −A to +A, from +B to −B, and from −C to +C, the coefficients of the prime diffusion filter 82 have reverse characteristics in the frame direction with the coefficients of the filter in the previous frame, that is, the prime diffusion filter 80.

Further, although the description above is of prime diffusion filters of 2 rows ×2 columns, the present invention is not limited to this configuration and it is possible to use prime diffusion filters of various sizes. For example, it is possible to use prime diffusion filters of 4 rows ×4 columns.

In addition, the description above is of prime diffusion filters of 2 rows ×2 columns in which four frames are repeated for application in the time direction. However, the present invention is not limited in this respect and it is possible for repetition to occur with a smaller number of frames. Also, in the case where a prime diffusion filter of a different row and column configuration is used, it is possible to utilize more than four frames. For example, if a prime diffusion filter of 3 rows ×3 columns is used, during application of the prime diffusion filter in the time direction, that is, in the frame direction, application may be performed by repeating 8 or 9 frames.

Finally, if the type and reverse direction characteristics of the coefficients are determined by the row and column configuration of the prime diffusion filter, the coefficients of +A, −B, +C, and −D of the prime diffusion filters may be changed in a variety of ways.

Figure 10:
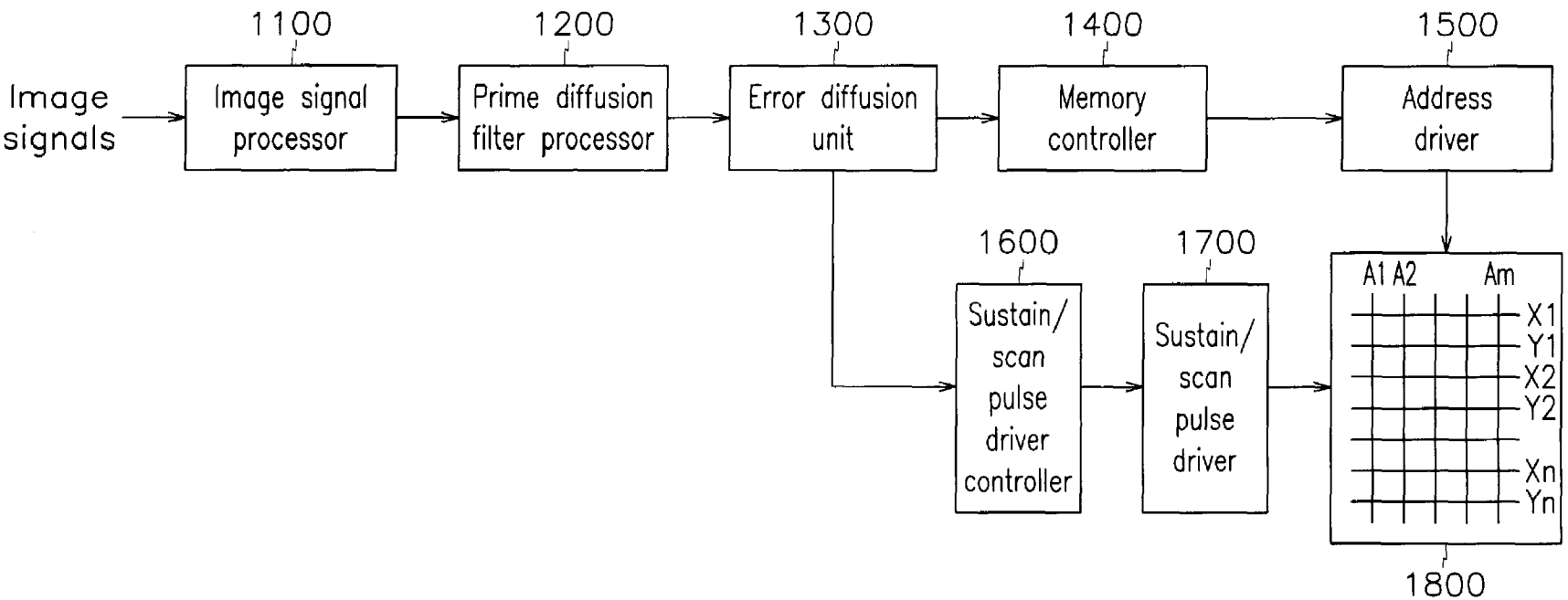
FIG. 10 is a block diagram of an image display system for a PDP according to a second preferred embodiment of the present invention.

FIG. 10 is a block diagram of an image display system for a PDP according to a second preferred embodiment of the present invention.

As shown in FIG. 10, an image display system for a PDP according to a second preferred embodiment of the present invention includes an image signal processor 1100, a prime diffusion filter processor 1200, an error diffusion unit 1300, a memory controller 1400, an address driver 1500, a sustain/scan pulse driver controller 1600, and a sustain/scan pulse driver 1700. Reference numeral 1800 indicates a PDP. The image signal processor 1100 digitizes 50 Hz PAL image signals, which are received externally, to generate RGB image data, after which the image signal processor 1100 outputs the RGB image data. The image signal processor 1100 also performs a gamma correction process with respect to gamma values to correspond to the characteristics of the PDP 1800.

The prime diffusion filter processor 1200 applies a prime diffusion filter as shown to FIG. 8 to the RGB image data output from the image signal processor 1100 to convert the data into image data of a specific pattern, then outputs the converted data. A prime diffusion filter coefficient or a coefficient in which a prime diffusion filter coefficient and a real diffusion filter coefficient are combined may be used as a coefficient of the prime diffusion filter. Further, those skilled in the art may easily anticipate the use of a prime diffusion filter of a configuration other than that shown in FIG. 8.

The error diffusion unit 1300 applies display errors diffused and received from peripheral pixels with respect to the image data output from the prime diffusion filter processor 1200. The error diffusion unit 1300 then outputs a result of this process.

The memory controller 1400 generates sub-field data corresponding to the RGB image data output from the error diffusion unit 1300. The sub-field data are such that the sub-fields in one field are divided into two groups (G1 and G2), and a weight arrangement of the sub-fields for each group is identical or all sub-field arrangements except for an LSB (Least Significant Bit) sub-field have the same structure. Alternatively, a brightness weighting value in each of the two sub-field groups is identically distributed.

The address driver 1500 generates address data corresponding to the sub-field data output by the memory controller 1400. The address driver 1500 then applies the address data to address electrodes (A1, A2, . . . Am) of the PDP 1800.

The sustain/scan pulse driver controller 1600 generates a sub-field arrangement structure corresponding to the RGB image data output by the error diffusion unit 1300, and also generates a control signal based on the generated sub-field arrangement structure. The sustain/scan pulse driver controller 1600 then outputs the control signal to the sustain/scan pulse driver 1700. The sustain/scan pulse driver 1700 generates a sustain pulse and a scan pulse according to the control signal output by the sustain/scan pulse driver controller 1600, then applies the sustain pulse and the scan pulse respectively to sustain electrodes (X1, X2, . . . Xn) and scan electrodes (Y1, Y2, . . . Yn) of the PDP 1800.

In the image display system for a PDP according to the second preferred embodiment of the present invention, the prime diffusion filter processor 1200 is positioned between the image signal processor 1100 and the error diffusion unit 1300.

In this instance, in reference to FIGS. 1 to 4, the prime diffusion filter processor 1200 performs prime diffusion filter process on the image data, and the image data that have undergone the prime diffusion filter process is input to the error diffusion unit 1300 to undergo the error diffusion process. As a result, abnormal patterns rarely occur at specific grays.

Figure 11:
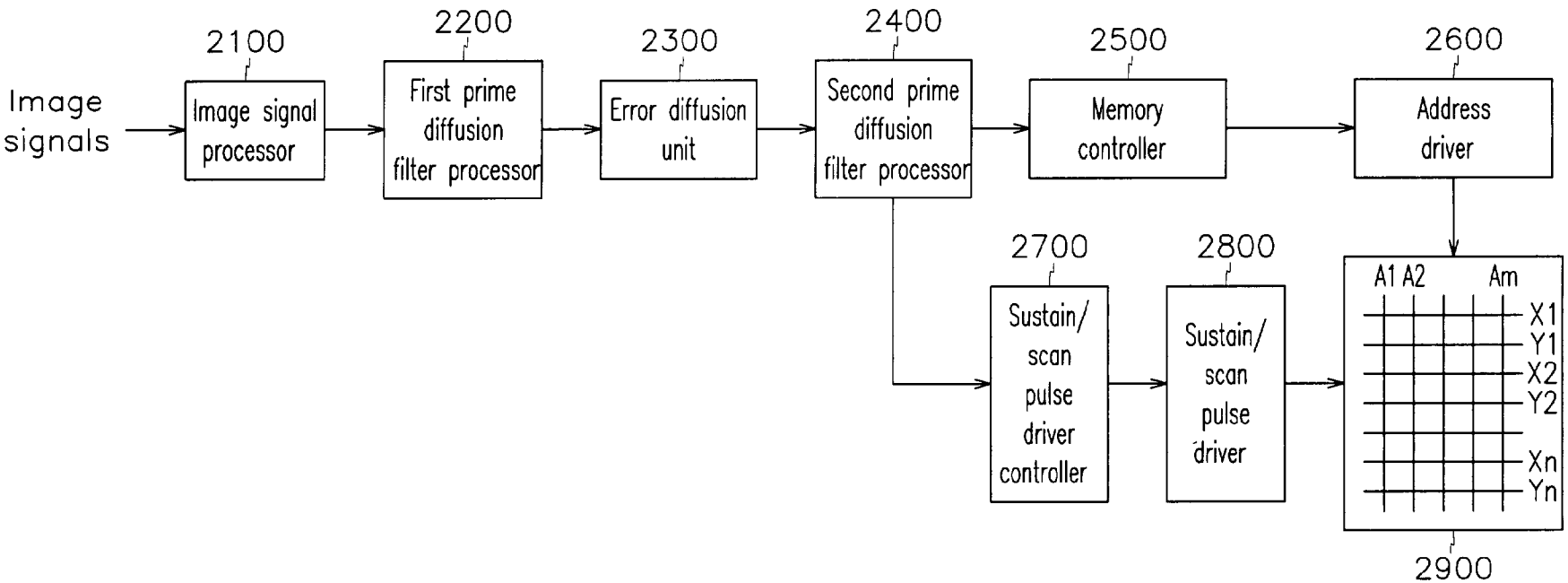
FIG. 11 is a block diagram of an image display system for a PDP according to a third preferred embodiment of the present invention.

FIG. 11 is a block diagram of an image display system for a PDP according to a third preferred embodiment of the present invention.

As shown in FIG. 11, an image display system for a PDP according to a third preferred embodiment of the present invention includes an image signal processor 2100, a first prime diffusion filter processor 2200, an error diffusion unit 2300, a second prime diffusion filter processor 2400, a memory controller 2500, an address driver 2600, a sustain/scan pulse driver controller 2700, and a sustain/scan pulse driver 2800. Reference numeral 2900 indicates a PDP. The image signal processor 2100 digitizes 50 Hz PAL image signals, which are received externally, to generate RGB image data, after which the image signal processor 2100 outputs the RGB image data. The image signal processor 2100 also performs a gamma correction process with respect to gamma values to correspond to the characteristics of the PDP 2900.

Among the RGB image data output by the image signal processor 2100, the first prime diffusion filter processor 2200 applies a prime diffusion filter to the RGB image data of low gray regions to convert the data into image data of a specific pattern, then outputs the converted data. Those skilled in the art may easily anticipate the use of a prime diffusion filter of many types in addition to that shown in FIG. 8. A prime diffusion filter coefficient or a coefficient in which a prime diffusion filter coefficient and a real diffusion filter coefficient are combined may be used as a coefficient of the prime diffusion filter.

The error diffusion unit 2300 applies display errors diffused and received from peripheral pixels with respect to the image data output from the first prime diffusion filter processor 2200. The error diffusion unit 2300 then outputs a result of this process.

Among the RGB image data output by the image signal processor 2100, the second prime diffusion filter processor 2400 applies a prime diffusion filter to the RGB image data of intermediate gray regions and high gray regions to convert the data into image data of a specific pattern, then outputs the converted data. Those skilled in the art may easily anticipate the use of a prime diffusion filter of many types in addition to that shown in FIG. 8. A prime diffusion filter coefficient or a real diffusion filter coefficient may be used as a coefficient of the prime diffusion filter.

The memory controller 2500 generates sub-field data corresponding to the image data output from the second prime diffusion filter processor 2400. The sub-field data are such that the sub-fields in one field are divided into two groups (G1 and G2), and a weight arrangement of the sub-fields for each group is identical or all sub-field arrangements except for an LSB (Least Significant Bit) sub-field have the same structure. Alternatively, a brightness weighting value in each of the two sub-field groups is identically distributed.

The address driver 2600 generates address data corresponding to the sub-field data output by the memory controller 2500. The address driver 2600 then applies the address data to address electrodes (A1, A2, . . . Am) of the PDP 2900.

The sustain/scan pulse driver controller 2700 generates a sub-field arrangement structure corresponding to the image data output by the second prime diffusion filter processor 2400, and also generates a control signal based on the generated sub-field arrangement structure. The sustain/scan pulse driver controller 2700 then outputs the control signal to the sustain/scan pulse driver 2800. The sustain/scan pulse driver 2800 generates a sustain pulse and a scan pulse according to the control signal output by the sustain/scan pulse driver controller 2700, then applies the sustain pulse and the scan pulse respectively to sustain electrodes (X1, X2, . . . Xn) and scan electrodes (Y1, Y2, . . . Yn) of the PDP 2900.

In the image display system for a PDP according to the third preferred embodiment of the present invention, the first prime diffusion filter processor 2200 is positioned between the image signal processor 2100 and the error diffusion unit 2300, and the second prime diffusion filter processor 2400 is positioned following the error diffusion unit 2300.

As described above, image data corresponding to the low gray regions undergo the prime diffusion filter process by the first prime diffusion filter processor 2200, and image data corresponding to the intermediate to high gray regions undergo the prime diffusion filter process by the second prime diffusion filter processor 2400. That is, image data of the low gray regions that are highly affected by the diffusion filter coefficient undergo the prime diffusion filter process by the first prime diffusion filter processor 2200, while image data of the intermediate to high gray regions that are minimally affected by the diffusion filter coefficient undergo the prime diffusion filter process by the second prime diffusion filter processor 2400. Therefore, it is possible to use only a prime diffusion filter coefficient or a real diffusion filter coefficient by the second prime diffusion filter processor 2400 and still avoid the generation of abnormal patterns at these specific grays.

In the image display method and system for a PDP of the present invention described above, diffusion filter values are applied to original grays, which are determined by 50 Hz PAL image signals, in which the diffusion filter values are determined according to states of reference signals generated based on basic signals which are, in turn, generated by 50 Hz PAL image signals. As a result, flicker and contour noise occurring with the display of images by dividing sub-fields into two groups are reduced.

Further, in the case where image signals converted into predetermined pattern signals through diffusion filters are added to image signals converted by an error diffusion process, the generation of interference patterns does not occur.

Finally, by using prime diffusion filter coefficients, contour noise is reduced while experiencing almost no increase in address power consumption.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An image display method for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the method comprising:

generating original grays based on the input image signals;

determining a diffusion filter value based on the input image signals;

generating final grays by applying the diffusion filter value to the generated original grays;

generating gray data corresponding to the generated final grays, the gray data being distributed over the two sub-field groups; and displaying an image on the plasma display panel according to the generated gray data.

2. The method of claim 1, wherein the diffusion filter value is established differently for an even field and for an odd field of the input image signals.

3. The method of claim 2, wherein the diffusion filter value for the even field and the diffusion filter value for the odd field are established to compensate for each other with respect to random pixels.

4. The method of claim 1, wherein the diffusion filter value is added to the original grays to generate the final grays.

5. The method of claim 1, further comprising:

generating basic signals based on the input image signals, the basic signals being generated prior to the generation of the original grays, wherein the diffusion filter value is determined according to states of the generated basic signals.

6. The method of claim 5, wherein the diffusion filter value takes on one of a value of 0, +k, and −k, where k is a diffused filter coefficient and a positive integer, and this value is determined according to the states of the basic signals.

7. The method of claim 6, wherein the diffused filter coefficient takes on a different value according to the original grays.

8. The method of claim 7, wherein the diffused filter coefficient takes on a smaller value for low gray regions of the original grays than it does for high gray regions of the original grays.

9. An image display system for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system comprising:

an image signal processor digitizing the input image signals to generate digital image data;

a sub-field coding unit applying a diffusion filter value, which is determined based on the input image signals, to original grays generated based on the digital image data generated by the image signal processor to thereby generate final grays, and generating gray data corresponding to the final grays, the gray data being distributed over the two sub-field groups; and an address designating unit performing control such that images corresponding to the gray data output by the sub-field coding unit are displayed on the plasma display panel.

10. The system of claim 9, wherein the sub-field coding unit comprises:

a look-up table providing pre-established gray data corresponding to the grays;

an original gray generator for determining the original grays corresponding to the digital image data generated by the image signal processor; and a diffusion filter application unit applying the diffusion filter value, which is determined based on the input image signals, to the original grays generated by the original gray generator to generate the final grays, and generating the gray data corresponding to the final grays by referencing the look-up table, after which the diffusion filter application unit outputs the gray data to the address designating unit.

11. The system of claim 10, wherein the image display system further comprises:

a basic signal generator generating basic signals based on the input image signals for processing the image signals, wherein the sub-field coding unit determines the diffusion filter value based on states of the basic signals generated by the basic signal generator.

12. The system of claim 11, wherein the sub-field coding unit further comprises:

a reference signal generator generating reference signals for determining the diffusion filter value, the reference signals being generated based on the basic signals generated by the basic signal generator.

13. The system of claim 12, wherein the diffusion filter takes on one of a value of 0, +k, and −k, where k is a diffused filter coefficient and is a positive integer, and this value is determined according to the states of the basic signals.

14. The system of claim 13, wherein the diffused filter coefficient takes on a different value according to the original grays.

15. The system of claim 14, wherein the diffused filter coefficient takes on a smaller value for low gray regions of the original grays than it does for high gray regions of the original grays.

16. An image display method for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the method comprising:

converting original image data corresponding to the image signals by using one or more prime diffusion filters having prime diffusion filter coefficients;

generating final image data by performing an error diffusion process on the converted original image data by regarding a portion of gray data of the image data as errors and diffusing the errors to the adjacent pixels by a predetermined amount corresponding to each adjacent pixel; and performing control such that images corresponding to the generated final image data are displayed on the plasma display panel.

17. The method of claim 16, wherein the prime diffusion filter coefficients are prime number coefficients or coefficients obtained by combining a prime number and a real number.

18. The method of claim 16, wherein the prime diffusion filter coefficients possessed by the prime diffusion filter(s) are realized by pattern signals that have reverse characteristics in a horizontal direction and in a vertical direction with respect to the pixels.

19. The method of claim 18, wherein the prime diffusion filter coefficients possessed by the prime diffusion filter(s) are realized by pattern signals that have reverse characteristics in a time direction with respect to the pixels, and wherein the time direction is specified by a plurality of frames, and prime diffusion filter coefficients possessed by each prime diffusion filter applied to each of the frames are realized by pattern signals that have reverse characteristics with respect to adjacent frames.

20. An image display method for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields being combined to display grays, the method comprising:

converting original image data corresponding to the image signals by using a first prime diffusion filter having a first prime diffusion filter coefficient;

performing an error diffusion process on the converted original image data by regarding a portion of gray data of the image data as errors and diffusing the errors to the adjacent pixels by a predetermined amount corresponding to each adjacent pixel;

converting the image data having undergone the error diffusion process to generate final image data, the converting of the image data being performed by using a second prime diffusion filter having a second prime diffusion filter coefficient; and performing control such that images corresponding to the generated final image data are displayed on the plasma display panel.

21. The method of claim 20, wherein the first prime diffusion filter applies the first prime diffusion filter coefficient to the input image data corresponding to low gray regions.

22. The method of claim 21, wherein the first prime diffusion filter coefficient is a prime number coefficient or a coefficient obtained by combining a prime number and a real number.

23. The method of claim 21, wherein the second prime diffusion filter applies the second prime diffusion filter coefficient to the input image data corresponding to a region extending from intermediate gray regions to high gray regions.

24. The method of claim 23, wherein the second prime diffusion filter coefficient is a prime number coefficient or a real number coefficient.

25. An image display system for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system comprising:

an image signal processor generating digital image data by digitizing the input image signals;

a prime diffusion filter processor converting the digital image data by using a specified prime diffusion filter coefficient on the digital image data output by the image signal processor, then outputting a result of this process;

an error diffusion unit generating final image data by performing an error diffusion process on the image data output from the prime diffusion filter processor by regarding a portion of gray data of the image data as errors and diffusing the errors to the adjacent pixels by a predetermined amount corresponding to each adjacent pixel;

a memory controller generating sub-field data corresponding to the final image data generated by the error diffusion unit, and applying the sub-field data to the plasma display panel; and a sustain/scan pulse driver controller generating a sub-field arrangement structure corresponding to the final image data generated by the error diffusion unit, generating control signals based on the generated sub-field arrangement structure, and applying the control signals to the plasma display panel.

26. The system of claim 25, wherein the prime diffusion filter coefficient is a coefficient of a prime number or a coefficient obtained by combining a prime number and a real number.

27. The system of claim 25, wherein the prime diffusion filter coefficient is realized by pattern signals that have reverse characteristics in a horizontal direction and in a vertical direction with respect to the pixels.

28. The system of claim 27, wherein the prime diffusion filter coefficient is realized by pattern signals that have reverse characteristics in a time direction with respect to the pixels, and wherein the time direction is specified by a plurality of frames, and the prime diffusion filter coefficients possessed by each prime diffusion filter applied to each of the frames are realized by pattern signals that have reverse characteristics with respect to adjacent frames.

29. An image display system for a plasma display panel, in which an image of each field displayed on the plasma display panel corresponding to 50 Hz input image signals is divided into a plurality of sub-fields of different weights, the sub-fields again being divided into two continuous sub-field groups and a weighting value of the sub-field groups being different, and in which the weighting values of the sub-fields are combined to display grays, the system comprising:

an image signal processor generating digital image data by digitizing the input image signals;

a first prime diffusion filter processor converting the digital image data by using a specified first prime diffusion filter coefficient on the digital image data output by the image signal processor, then outputting a result of this process;

an error diffusion unit generating image data by performing an error diffusion process by regarding a portion of gray data of the input image signals as errors and diffusing the errors in the image data converted and output by the first prime diffusion filter processor to correspond to each adjacent pixel;

a second prime diffusion filter processor converting the image data having undergone the error diffusion process by using a specified second prime diffusion filter coefficient on the image data having undergone the error diffusion process by the error diffusion unit, then outputting resulting final image data;

a memory controller generating sub-field data corresponding to the final image data generated by the second prime diffusion filter processor, and applying the sub-field data to the plasma display panel; and a sustain/scan pulse driver controller generating a sub-field arrangement structure corresponding to the final image data generated by the second prime diffusion filter processor, generating control signals based on the generated sub-field arrangement structure, and applying the control signals to the plasma display panel.

30. The system of claim 29, wherein the first prime diffusion filter applies the first prime diffusion filter coefficient to the input image data corresponding to low gray regions.

31. The system of claim 30, wherein the first prime diffusion filter coefficient is a prime number coefficient or a coefficient obtained by combining a prime number and a real number.

32. The system of claim 30, wherein the second prime diffusion filter applies the second prime diffusion filter coefficient to the input image data corresponding to a region extending from intermediate gray regions to high gray regions.

33. The method of claim 32, wherein the second prime diffusion filter coefficient is a prime number coefficient or a real number coefficient.

* * * * *